United States Patent [19]

Laziou

[11] Patent Number: 4,881,876

[45] Date of Patent: Nov. 21, 1989

[54] DEVICE FOR DETECTING THAT A MEMBRANE IN A MEMBRANE PUMP HAS BROKEN

[75] Inventor: Alain Laziou, Romilly S/Andelle, France

[73] Assignee: Dosapro Milton Roy, France

[21] Appl. No.: 284,629

[22] Filed: Dec. 14, 1988

[30] Foreign Application Priority Data

Dec. 17, 1987 [FR] France ..... 87 17636

[51] Int. Cl.[4] ..... F04B 43/06; F04B 45/04

[52] U.S. Cl. ..... 417/63; 417/395; 417/413; 92/98 R

[58] Field of Search ..... 417/63, 389, 395, 413; 92/98 R, 103 R

[56] References Cited

U.S. PATENT DOCUMENTS

| | | | |
|---|---|---|---|
| 2,662,478 | 12/1953 | Burre | 417/63 |
| 3,131,638 | 5/1964 | Wilson et al. | 417/395 X |
| 3,605,566 | 9/1971 | Vetter | 417/63 X |
| 3,661,060 | 5/1972 | Bowen | 417/63 X |
| 4,569,634 | 2/1986 | Mantell | 417/395 X |
| 4,781,535 | 11/1988 | Frawley et al. | 417/63 X |
| 4,787,825 | 11/1988 | Mantell | 417/395 X |

FOREIGN PATENT DOCUMENTS

| | | | |
|---|---|---|---|
| 1226740 | 10/1966 | Fed. Rep. of Germany . | |
| 3146222 | 1/1983 | Fed. Rep. of Germany . | |
| 3334638 | 3/1984 | Fed. Rep. of Germany | 417/63 |
| 2533636 | 3/1984 | France . | |

*Primary Examiner*—Carlton R. Croyle
*Assistant Examiner*—Eugene L. Szczecina, Jr.
*Attorney, Agent, or Firm*—Griffin, Branigan & Butler

[57] ABSTRACT

The groove (13) for detecting the presence of a fluid between the membranes (1, 2) and indicating that one or other of them has broken, is profiled so as to be bullet-shaped, thereby preventing the membranes from being extruded into the groove under the effect of pumping pressure.

4 Claims, 1 Drawing Sheet

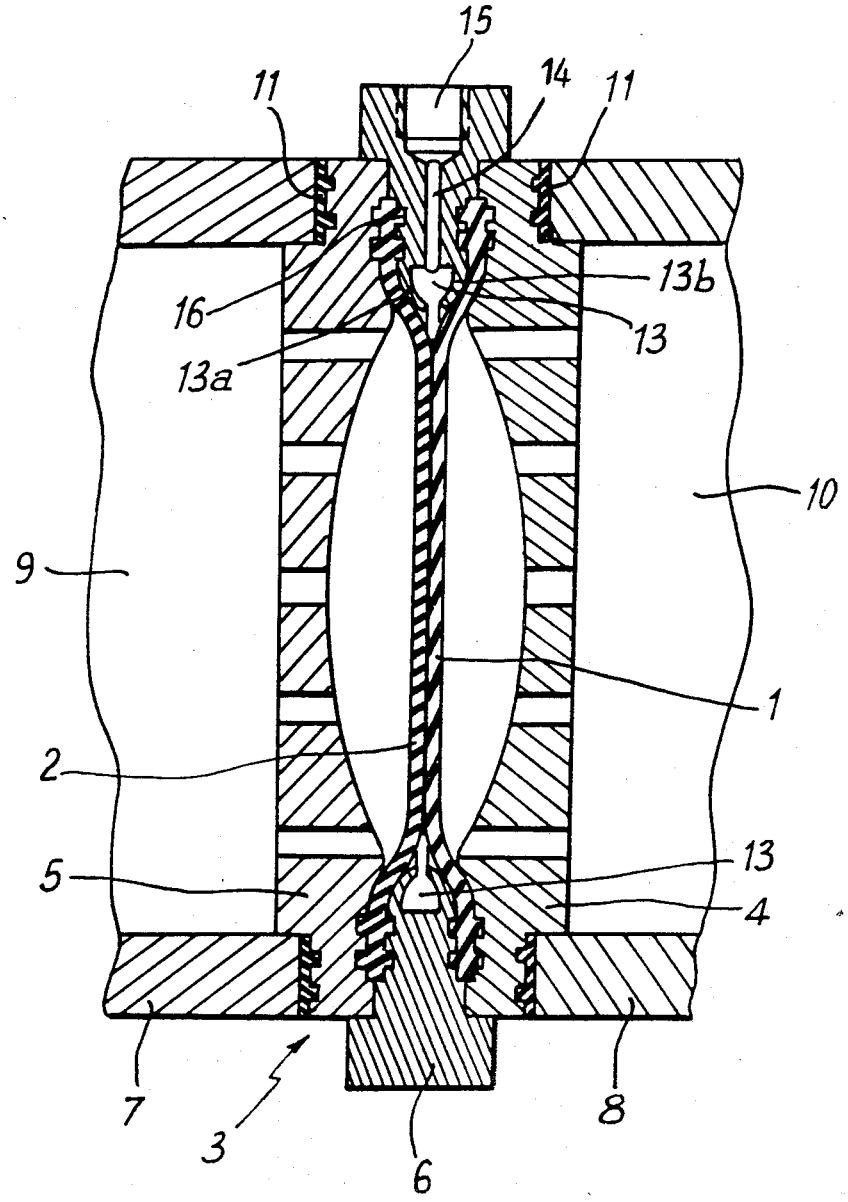
15
14
11
11
16
13b
13
13a
10
9
1
2
5
13
4
7
3
6
8

DEVICE FOR DETECTING THAT A MEMBRANE IN A MEMBRANE PUMP HAS BROKEN

BACKGROUND OF THE INVENTION

In a membrane pump, it is known to separate the working chamber from the hydraulic control chamber by means of a double flexible wall constituted by two parallel membranes. This disposition increases operating security since a break in one of the membranes does not cause the pumped fluid to propagate into the moving parts of the pump. Such propagation is to be avoided since the fluid driven by the pump is often corrosive in nature.

In order to provide means for monitoring the state of the membranes, the space between them is put into communication with the outside of the pump by means of a duct provided with a discharge valve. Thus, a flow through said duct constitutes a sign that a membrane has broken.

A practical implementation of such break detection comprises an annular spacer interposed between the peripheral portions of the two membranes. A radial passage is provided through said spacer leading to the space between the membranes. In order to ensure that the end of said passage is not closed by the membranes (with the volume between the membranes being kept to a minimum during operation of the pump) a groove is formed in the inside surface of the spacer to constitute the peripheral extremity of said space, and the opening of said duct opens out into the bottom of the groove.

It is also common practice for the two membranes and the intermediate spacer which is sandwiched between the membranes to be fixed in the body of the pump by clamping between an annular bearing surface provided on the pump body (on its hydraulic control chamber side) and an annular bearing surface provided on the pump head (on its working chamber side) when said head and body are assembled to each other. More precisely, these bearing surfaces are provided in the front and rear grids for supporting the membranes in each of their extreme positions.

One of the consequences of this mode of assembly and of the vacuum set up between the membranes by the external pressure is that as each of the membranes moves back and forth, it tends to extrude itself into the groove in the annular spacer. This tendency is an important factor in membrane damage, and it rapidly gives rise to breakage.

The invention seeks to remedy this fact by providing an improved device for detecting that a membrane has broken, which device is also easier to manufacture and cheaper than prior devices.

SUMMARY OF THE INVENTION

The present invention provides a device for detecting that a membrane in a hydraulically actuated membrane pump has broken, the device being constituted by an annular spacer sandwiched between the peripheral zones of at least two adjacent membranes, with the assembly being peripherally clamped between two pump body components, the annular spacer including at least one radial passage providing communication between the space delimited by the two membranes and the outside of the pump, wherein the radial passage opens out into a groove provided in the inside face of the annular spacer, with the walls of the groove converging towards each other.

Advantageously, the external profile in axial right cross-section of the spacer is bullet-shaped around the groove so as to follow the curvature of each of the membranes during their deflection during pumping.

A device in accordance with the invention is easily manufactured since, starting from a turned blank, the desired external profile can be imparted to the flanks of the groove merely by forcing them back towards each other while reducing the gap between them in order to prevent membrane material from penetrating into said groove.

BRIEF DESCRIPTION OF THE DRAWING

An embodiment of the invention is described by way of example with reference to the accompanying drawings, in which the sole FIGURE is a fragmentary section through an embodiment of a device in accordance with the invention.

MORE DETAILED DESCRIPTION

With reference to this FIGURE, two membranes 1 and 2 can be seen mounted in conventional manner in a pump body 3, i.e. by being clamped between a rear supporting grid 4 and a front supporting grid 5, together with an interposed annular spacer 6. The supporting grids 4 and 5 are themselves clamped between a component 7 of the pump body belonging to the pump head and a component 8 of the body constituting the frame of the pump. The component 7 defines a pumping chamber 9 while the component 8 delimits the hydraulic chamber 10 for actuating the pump. These components are clamped against each other on either side of the intervening grids and the annular spacer, together with sealing rings 11.

In numerous embodiments this assembly may suffice, particularly with reference to the presence or the absence or the shape of one or other of the grids. The dispositions specific to the invention as specified above apply to all such embodiments.

The annular spacer 6 includes an internal groove 13 whose volume is in communication with the inside space delimited between the membranes 1 and 2. This groove 13 communicates via at least one radial passage 14 with an external duct which is not shown but which may be connected to the spacer by means of a screw connection or by welding to an orifice 15, in conjunction with a non-return valve, where necessary. This external duct may lead to a detector for detecting that a membrane has broken, with said detector being constituted, for example, in the form of an alarm.

It may be observed that the side walls **13*a* and 13*b* of the groove 13 are forced back towards each other. The slot providing communication between the groove and the intermembrane space is thus narrower than the width of the bottom of the groove 13. As a result it is impossible for either of the membranes to penetrate into the groove 13 under the effect of the pressure in one or other of the chambers 9 and 10. Further, the outside surface of each wall 13*a* and 13*b* is curved so as to give the spacer 6 a profile in the vicinity of the groove 13** such that its axial section as shown in the FIGURE is bullet-shaped.

Thus, in the zone where the membrane is highly subjected to fatigue stress, the walls **13*a* and 13*b*** form a bearing surface whose shape is adapted to the curvature of the membrane and which prevents the membrane from bending through too small a radius of curvature.

In addition to the advantages described above, the advantage of this particular shape also lies in the fact that manufacture of the spacer 6 is very simple. After a blank has been made by turning and has been provided with a groove 13 having parallel side walls, these walls need only be forced back towards each other on a lathe or by flow turning in order to obtain a profiled groove 13. Such manufacture means there is no need to use a spacer made of two parts in order to obtain the same effect.

Finally, the flanks of the spacer include circular grooves 16 into which the membrane material flows by creep when the pump parts are clamped together. Similarly, the support plates may include grooves which also receive membrane material which flows into them by creep. The membranes may be made of polytetrafluoroethylene (PTFE) or they may be constituted by composite membranes including a layer of PTFE and a layer of elastomer. In either case the membranes are firmly held to the supporting structure and good fixing is obtained without leakage.

The invention is applicable to membrane pumps.

I claim:

1. A device for detecting that a membrane in a hydraulically actuated membrane pump has broken, the device being constituted by an annular spacer sandwiched between the peripheral zones of at least two adjacent membranes, with the assembly being peripherally clamped between two pump body components, the annular spacer including at least one radial passage providing communication between the space delimited by the two membranes and the outside of the pump, wherein the radial passage opens out into a groove provided in the inside face of the annular spacer, with the walls of the groove converging towards each other.

2. A device according to claim 1, wherein the external profile in axial right cross-section of the spacer is bullet-shaped at the groove.

3. A device according to claim 1, wherein the annular spacer is obtained by machining followed by deformation in order to profile the zone of said groove.

4. A device according to claim 1, wherein the spacer includes parallel end faces having circular grooves.

* * * * *